US009951711B2

(12) United States Patent
Kurata et al.

(10) Patent No.: US 9,951,711 B2
(45) Date of Patent: Apr. 24, 2018

(54) CONTROL DEVICE OF ENGINE

(71) Applicant: MITSUBISHI JIDOSHA KOGYO KABUSHIKI KAISHA, Tokyo (JP)

(72) Inventors: Kazuo Kurata, Kyoto (JP); Jun Akasegawa, Nagaokakyo (JP); Koji Satake, Kyoto (JP); Tetsuro Ishida, Kyoto (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 258 days.

(21) Appl. No.: 14/745,612

(22) Filed: Jun. 22, 2015

(65) Prior Publication Data

US 2015/0369166 A1 Dec. 24, 2015

(30) Foreign Application Priority Data

Jun. 23, 2014 (JP) ..... 2014-128241

(51) Int. Cl.
*F02D 35/00* (2006.01)
*F02D 41/40* (2006.01)
(Continued)

(52) U.S. Cl.
CPC ..... *F02D 41/401* (2013.01); *F02D 35/028* (2013.01); *F02D 41/0097* (2013.01);
(Continued)

(58) Field of Classification Search
CPC .. F02D 41/401; F02D 35/028; F02D 41/0097; F02D 41/0085; F02D 41/1497;
(Continued)

(56) References Cited

U.S. PATENT DOCUMENTS 4,495,920 A * 1/1985 Matsumura ..... F02D 41/0085 123/436
4,697,561 A * 10/1987 Citron ..... F02D 41/0085 123/339.14
(Continued)

FOREIGN PATENT DOCUMENTS

EP 2375034 A2 10/2011
JP 2956456 B2 10/1999
(Continued)

OTHER PUBLICATIONS

Extended European Search Report, dated Feb. 12, 2016, in corresponding European Patent Application No. 15172964.7.

*Primary Examiner* — Thomas Moulis
(74) *Attorney, Agent, or Firm* — Birch, Stewart, Kolasch & Birch, LLP

(57) ABSTRACT

A control device for an engine includes an angular velocity detecting unit that detects the angular velocity of a rotating shaft which is driven according to an output of an engine, an angular acceleration calculating unit that calculates angular acceleration based on the angular velocity detected by the angular velocity detecting unit, a heat generation timing calculating unit that calculates a certain timing when the ratio of an amount of heat generation in a cylinder to the total amount of heat generation of one cycle falls in a predetermined range, based on a change of the angular acceleration calculated by the angular acceleration calculating unit, and a combustion control unit that controls combustion in the cylinder by comparison between the certain timing calculated by the heat generation timing calculating unit and a predetermined heat generation timing reference value.

6 Claims, 10 Drawing Sheets

(51) Int. Cl.
*F02D 41/00* (2006.01)
*F02D 41/14* (2006.01)
*F02D 41/38* (2006.01)
*F02D 35/02* (2006.01)

(52) U.S. Cl.
CPC ..... *F02D 41/1444* (2013.01); *F02D 41/1498* (2013.01); *F02D 41/38* (2013.01); *F02D 2200/101* (2013.01); *F02D 2200/1012* (2013.01)

(58) Field of Classification Search
CPC ..... F02D 41/1498; F02D 41/16; F02D 2200/101; F02D 2200/1012; F02D 2200/1015
USPC ..... 123/436, 102–105, 111; 701/111
See application file for complete search history.

(56) References Cited

U.S. PATENT DOCUMENTS 5,331,848 A * 7/1994 Nakagawa ..... G01M 15/11 73/114.05
5,687,692 A 11/1997 Togai et al.
7,899,608 B1 * 3/2011 Pederson ..... G01M 15/11 701/111
9,284,906 B2 * 3/2016 Yun ..... F02D 41/3035
2003/0145836 A1 * 8/2003 Linna ..... F02B 1/12 123/501
2005/0071073 A1 * 3/2005 Ueda ..... F02D 37/02 701/101
2006/0032477 A1 * 2/2006 May ..... F02D 19/10 123/299
2007/0021903 A1 * 1/2007 Christen ..... F02D 35/023 701/108
2007/0051342 A1 3/2007 Kita
2008/0183367 A1 * 7/2008 Kapus ..... F02D 35/02 701/103
2009/0248277 A1 * 10/2009 Shinagawa ..... F02D 13/0238 701/103
2009/0282903 A1 * 11/2009 Nagano ..... F02D 41/0097 73/114.15
2009/0292447 A1 11/2009 Yamaguchi et al.
2009/0312932 A1 * 12/2009 Wang ..... F02D 35/024 701/102
2010/0030446 A1 * 2/2010 Fernitz ..... F02D 35/023 701/101
2010/0088010 A1 * 4/2010 Verdejo ..... B60K 6/485 701/105
2012/0271536 A1 * 10/2012 Hamedovic ..... F02D 35/02 701/111
2013/0000606 A1 * 1/2013 Watanabe ..... F02D 41/402 123/478
2013/0211694 A1 8/2013 Taglialatela et al.
2014/0309755 A1 * 10/2014 Olde Scheper ..... G05B 13/047 700/29
2015/0159569 A1 * 6/2015 Yu ..... F02D 41/009 123/435
2015/0369204 A1 * 12/2015 Ting ..... F02P 7/067 123/406.58

FOREIGN PATENT DOCUMENTS

JP 2007-71096 A 3/2007
JP 2009-281143 A 12/2009
JP 2011-202630 A 10/2011
JP 2011-220186 A 11/2011

* cited by examiner

CONTROL DEVICE OF ENGINE

CROSS REFERENCE TO RELATED APPLICATION

This application is based on Japanese Patent Application No. 2014-128241 filed on Jun. 23, 2014, the contents of which are incorporated herein by reference.

BACKGROUND

1. Technical Field

The present invention relates to a control device of an engine having a function of estimating the state of combustion in a cylinder.

2. Related Art

It is said that misfire in diesel engines is generally likely to occur when the amount of oxygen is deficient due to too much exhaust recirculation gas or a deficiency of supercharging pressure or when intake air temperature or water temperature decreases.

Fuel injection timings of diesel engines are generally determined on the basis of required torque which is determined by two factors, that is, engine speed and the opening of an accelerator pedal. Therefore, in order to prevent misfire, in addition to the above described control, it is required to correct fuel injection timing in response to the internal state of a cylinder such as a deficiency of the amount of oxygen or a decrease in the temperature.

However, from the viewpoint of environmental protection such as exhaust gas regulation, the filling ratio of exhaust recirculation gas tends to increase every year. For this reason, the width of setting of fuel injection timing enabling appropriate driving is limited to a narrow crank angle range, and the degree of freedom of control narrows.

Also, misfire attributable to a slight change in the driving condition is more likely to occur. Combustion fluctuation according to misfire leads to deterioration of drivability according to a decrease in torque, or increase in the emission of un-burnt hydrocarbon. Therefore, it is preferable to avoid combustion fluctuation as much as possible. Combustion fluctuation means change or variation in the combustion state of each cylinder for each combustion cycle.

In Japanese Patent No. 2956456 (see paragraphs [0058] and [0059] on page 6, a paragraph [0085] on page 8, and so on), there is disclosed a technology for grasping combustion fluctuation during lean combustion driving, and estimating combustion fluctuation of each cylinder on the basis of a difference between the instantaneous value and average value of the angular acceleration of a crankshaft, and performing combustion control, thereby reducing the combustion fluctuation.

In order to grasp combustion fluctuation of each cylinder, it is effective to install a combustion pressure sensor capable of detecting the combustion state of a cylinder. However, installation of a combustion pressure sensor leads to complication of the structure of an engine and an increase in the equipment cost. For this reason, sometimes, it may be impossible to use this combustion pressure sensor.

According to an engine control method disclosed in Japanese Patent No. 2956456, on the basis of a difference between the instantaneous value and average value of the angular velocity of a crankshaft, the combustion state of each cylinder is estimated.

However, it is impossible to exactly grasp whether the degree of progress of combustion in a cylinder, that is, variation of combustion fluctuation of each cylinder only on the basis of the instantaneous value of the angular velocity of the crankshaft.

For this reason, an object of the present invention is to more exactly grasp the internal combustion state of a cylinder and perform control such that the combustion state becomes satisfactory while suppressing an increase in cost, without complicating the structure of an engine.

SUMMARY OF THE INVENTION (1) According to an aspect of the invention, a control device for an engine includes an angular velocity detecting unit that detects the angular velocity of a rotating shaft which is driven according to an output of an engine, an angular acceleration calculating unit that calculates angular acceleration based on the angular velocity detected by the angular velocity detecting unit, a heat generation timing calculating unit that calculates a certain timing when the ratio of an amount of heat generation in a cylinder to the total amount of heat generation of one cycle falls in a predetermined range, based on a change of the angular acceleration calculated by the angular acceleration calculating unit, and a combustion control unit that controls combustion in the cylinder by comparison between the certain timing calculated by the heat generation timing calculating unit and a predetermined heat generation timing reference value.

(2) In the control device for an engine of (1), the certain timing is a gravity center position of total heat generation, and the heat generation timing calculating unit includes a gravity center position of total heat generation calculating unit.

(3) In the control device of (1) or (2), the angular acceleration change is calculated based on two angular accelerations which are obtained as references in chronological order, and of the values of the two angular accelerations, the value of the prior angular acceleration in chronological order is a value detected in a crank angle range including a top dead center in the beginning of an expansion stroke.

(4) In the control device of (3), the value of the prior angular acceleration in chronological order is a value calculated based on an angular velocity detected in a crank angle range including the top dead center in the beginning of the expansion stroke and an angular velocity detected in a crank angle range after the crank angle range including the top dead center.

(5) In the control device of any one of (2) to (4), the combustion control unit controls the gravity center position of total heat generation which is calculated by the gravity center position of total heat generation calculating unit such that the gravity center position of total heat generation becomes close to a gravity center position of total heat generation reference value.

(6) In the control device of any one of (2) to (5), control of the combustion control unit on the internal combustion state of a cylinder is performed by adjusting fuel injection timing or an amount of fuel injection.

(7) In the control device of any one of (2) to (6), the gravity center position of total heat generation is obtained based on a difference between two angular acceleration values which are obtained in chronological order and the generated torque of the engine.

DESCRIPTION OF PREFERRED EMBODIMENT

Figure 1:
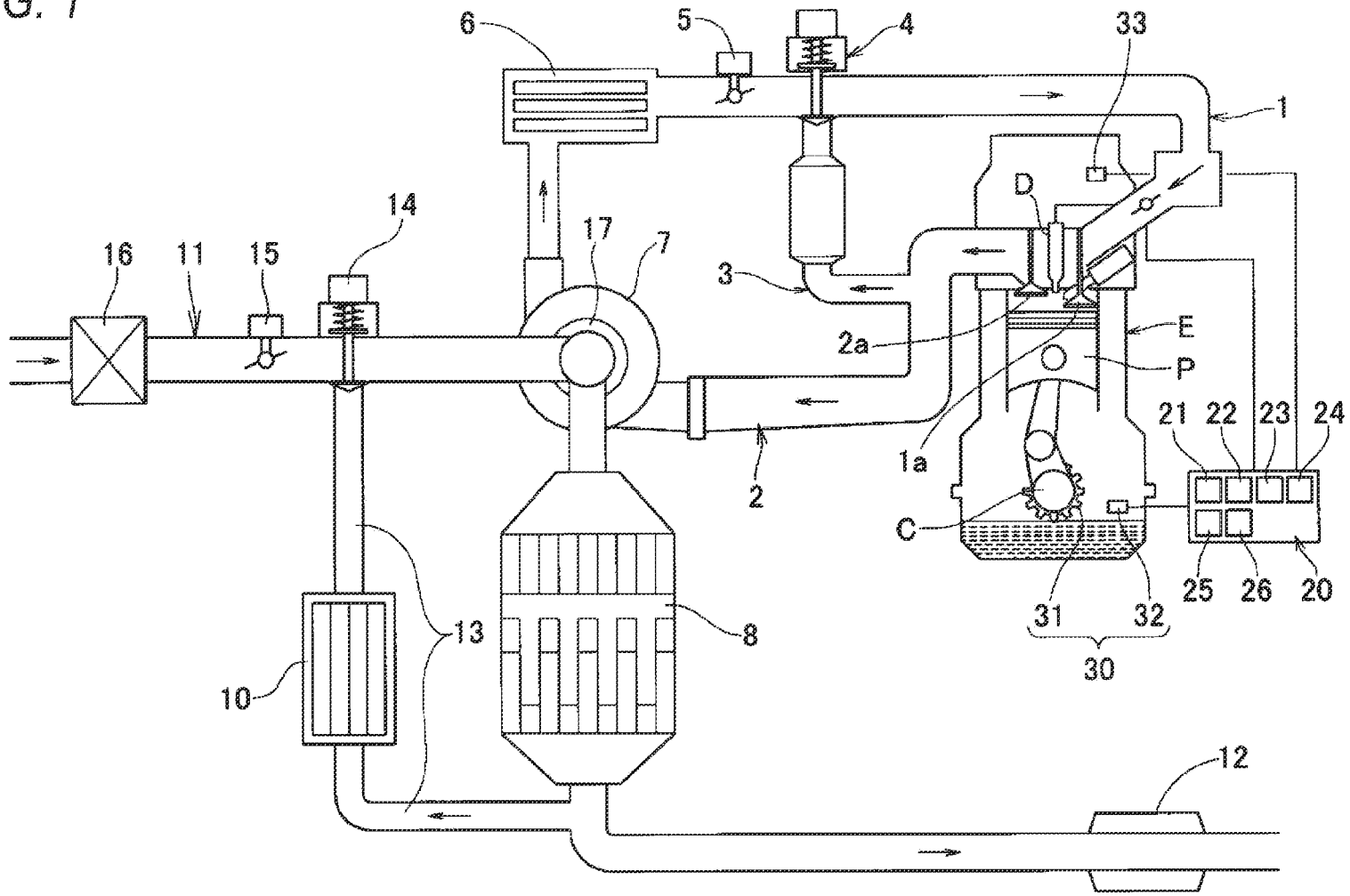
FIG. 1 is a schematic diagram illustrating a configuration of a control device of an engine of the present invention.

Hereinafter, an embodiment of the present invention will be described with reference to the accompanying drawings. FIG. 1 is a schematic diagram conceptually illustrating a control device of an engine of the present embodiment.

An engine E of the present embodiment is a diesel engine for a vehicle. As shown in FIG. 1, the configuration of the engine E includes an intake port for sending intake air into a cylinder storing a piston P, an intake passage 1 which is connected to the intake port, an exhaust passage 2 which is drawn from an exhaust port, a fuel injector D, and so on. The intake port and the exhaust port are opened and closed by valves 1*a* and 2*a*, respectively.

In the present embodiment, a multi-cylinder engine having a plurality of cylinders is assumed, and FIG. 1 shows one of the plurality of cylinders. However, the present invention can be applied regardless of the number of cylinders.

On the intake passage 1, from the intake port toward the upstream side, a high-pressure throttle valve 5 for adjusting the flow passage area of the intake port, an intake air cooler (inter-cooler) 6 for cooling intake air flowing in the intake passage 1, and a turbocharger compressor 17 are provided, and on an intake passage 11 on the upstream side from the intake passage 1, a low-pressure throttle valve 15 for adjusting the flow passage area, an air cleaner 16, and so on are provided.

On the exhaust passage 2, from the exhaust port toward the downstream side, a turbocharger turbine 7, an exhaust emission control unit 8 having a catalyst for removing un-burnt hydrocarbon (HC) and the like from exhaust gas, and a muffler 12 are provided.

An intermediate portion between the turbine 7 of the exhaust passage 2 and the exhaust port and an intermediate portion between the intake port of the intake passage 1 and the first throttle valve 5 are connected to each other by a high-pressure exhaust gas recirculation passage 3 constituting a high-pressure exhaust gas recirculation device. Through the high-pressure exhaust gas recirculation passage 3, a portion of exhaust gas which is discharged from the engine E recirculates as recirculation gas into the intake passage 1. On the high-pressure exhaust gas recirculation passage 3, a high-pressure exhaust gas recirculation valve 4 is provided. In response to the internal pressure state of the intake passage 1 according to opening/closing of the high-pressure exhaust gas recirculation valve 4 and opening/closing of the first throttle valve 5, the recirculation gas joins intake air in the intake passage 1.

Also, an intermediate portion between the exhaust emission control unit 8 of the exhaust passage 2 and the muffler 12 and an intermediate portion between the compressor 17 of the intake passage 11 and the low-pressure throttle valve 15 are connected to each other by a low-pressure exhaust gas recirculation passage 13 constituting a low-pressure exhaust gas recirculation device. Through the low-pressure exhaust gas recirculation passage 13, a portion of exhaust gas which is discharged from the engine E recirculates as recirculation gas toward the upstream side of the turbocharger compressor 17 of the intake passage 11. On the low-pressure exhaust gas recirculation passage 13, a low-pressure exhaust gas recirculation valve 14 is provided. In response to the internal pressure state of the intake passage 11 according to opening/closing of the low-pressure exhaust gas recirculation valve 14 and opening/closing of the low-pressure throttle valve 15, the recirculation gas joins intake air in the intake passage 11. In FIG. 1, a reference symbol "10" represents a recirculation gas cooler for cooling the recirculation gas of the low-pressure exhaust gas recirculation passage 13.

A vehicle in which the engine E is installed has an electronic control unit 20 for controlling the engine.

The electronic control unit 20 includes a fuel injection performing means 25 which performs fuel injection by the fuel injector D based on an engine operation state. Also, the electronic control unit 20 includes a control means 26 which issues commands necessary for control on supercharging pressure, control on opening of the first throttle valve 5 or the low-pressure throttle valve 15, or other control of the engine.

Also, the electronic control unit 20 includes an angular velocity detecting means 21 which detects the angular acceleration of a crankshaft (a rotating shaft) C which is driven according to the output of the engine E, an angular acceleration calculating means 22 which calculates angular acceleration based on the angular velocity detected by the angular velocity detecting means 21, and a heat generation timing calculating means 23 which calculates a certain timing when the ratio of the amount of heat generation in a cylinder to the total amount of heat generation of one cycle becomes a predetermined ratio, based on change in the angular acceleration which is calculated by the angular acceleration calculating means 22.

In the present embodiment, as the certain timing which is calculated by the heat generation timing calculating means 23, a gravity center position of total heat generation G which is timing when the amount of heat generation becomes 50% with respect to the total amount of heat generation of one cycle is used. Hereinafter, in the present embodiment, the certain timing is referred to as the gravity center position of total heat generation G, and the heat generation timing calculating means 23 is referred to as a gravity center position of total heat generation calculating means 23.

Further, the electronic control unit 20 includes a combustion control means 24 which controls combustion in the cylinder by comparing the gravity center position of total heat generation G which is calculated by the heat generation timing calculating means 23 with a predetermined gravity center position of total heat generation reference value $G_0$. The combustion control means 24 commands the fuel injection performing means 25 to correct necessary fuel injection timing. Further, after commanding correction of fuel injection timing, if necessary, the combustion control means 24 can command the fuel injection performing means 25 to correct a fuel injection amount.

Figure 2:
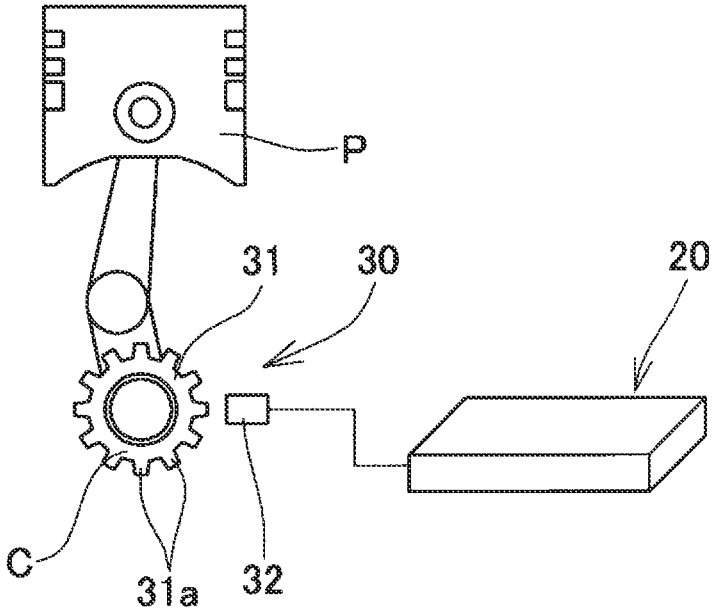
FIG. 2 is a schematic diagram illustrating a configuration of a rotation sensor for detecting rotation of a crankshaft of the engine.

As shown in FIGS. 1 and 2, the angular velocity detecting means 21 acquires information from a crank angle sensor 30 and a cylinder discriminating sensor 33 provided in the engine E.

The crank angle sensor 30 includes a rotating member 31 which rotates integrally with the crankshaft C of the engine, and a plurality of vanes 31*a* formed at the peripheral edge of the rotating member 31 so as to protrude toward the outer side in a radial direction. The vanes 31*a* are provided at regular intervals along the circumferential direction of the rotating member 31, and the length between every neighboring vanes 31*a* in the radial direction corresponds to the predetermined rotation angle of the crankshaft C. A detector 32 provided so as to face the vanes 31*a* optically or electromagnetically detects passage of a vane 31*a* according to rotation of the rotating member 31, and outputs a pulse based on the detection of vane passage. (See the crankshaft pulse of FIG. 3.)

The cylinder discriminating sensor 33 is provided on a camshaft in a cylinder head. While the crankshaft C rotates around its axis twice whereby the camshaft rotates around its axis once, whenever the camshaft takes a specific rotation position corresponding to one cylinder, the cylinder discriminating sensor 33 outputs a predetermined pulse. (See the camshaft pulse of FIG. 3.)

As for detection of the angular acceleration, during an operation of the engine E, the electronic control unit 20 repeatedly performs detection of the angular acceleration by acquiring the pulse output from the crank angle sensor 30 and the detection signal of the cylinder discriminating sensor 33 and performing calculation.

The electronic control unit 20 determines what number the pulse output from the crank angle sensor 30 is from the specific pulse output from the cylinder discriminating sensor 33. Thereby, the electronic control unit 20 determines which of an intake stroke, a compression stroke, an expansion stroke, and an exhaust stroke of each cylinder the pulse input from the crank angle sensor 30 corresponds to, that is, what is the number of a cylinder for which the input pulse is used to calculate the gravity center position of total heat generation G. Specifically, when the pulse is acquired, the electronic control unit 20 determines what is the number of a cylinder which is performing an expansion stroke (for example, before and after the top dead center of the expansion stroke).

The electronic control unit 20 starts the timer of the cylinder determined corresponding to the pulse from the crank angle sensor 30 (or a cylinder group including the determined cylinder and making progress by the same process as that of the determined cylinder).

After the timer starts, if the electronic control unit 20 acquires a predetermined number of pulses from the crank angle sensor 30, it stops the timer, and acquires the elapsed time from the start of the timer. This time measurement result means time which is required for the crankshaft C to rotate by a predetermined rotation angle, and the elapsed time is hereinafter referred to as a predetermined angle passage time.

Figure 3:
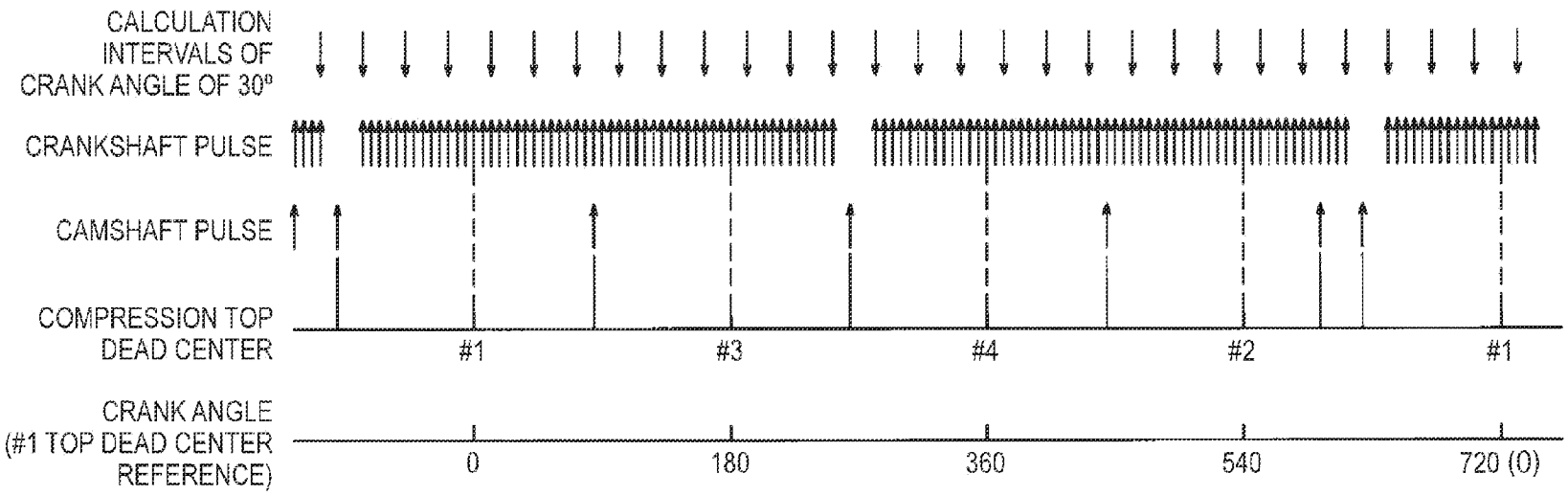
FIG. 3 is a schematic diagram illustrating an example of a pulse for detecting rotation of the crankshaft.

In the present embodiment, as shown in the crankshaft pulse of FIG. 3, the vanes 31*a* are 60 teeth arranged at intervals of 6° (however, since the vanes include missing teeth for identification, 56 pulses), and the predetermined angle passage time is a time required for an angle corresponding to passage of five vanes 31*a*, that is, a rotation angle of 30° of the crankshaft C, as shown in the calculation intervals of crankangle of 30° of FIG. 3. This angle may be any angle other than 30°, for example, 20° or 15°.

The angular velocity detecting means 21 calculates an angular velocity average while the crankshaft rotates by the predetermined rotation angle (30°), based on the predetermined angle passage time.

An expression for the calculation is, for example, as follows.

$$\omega_n(\text{Angular Velocity})=(\pi/6)\div(T_{ca(n)}) \qquad \text{(Expression 1)}$$

Here, $T_{ca(n)}$ represents the n-th time from timer start in the predetermined angle passage time for each predetermined rotation angle (30°=π/6 rad) acquired corresponding to the determined cylinder.

The angular acceleration calculating means 22 calculates the angular acceleration based on information on the angular velocities. The angular acceleration is calculated based on two angular velocities obtained along the time series, and in the present embodiment, two angular velocities neighboring along the time series are used.

An expression for the calculation is, for example, as follows.

$$\alpha_{n-1\sim n}(\text{Angular Acceleration}) = \frac{d^2\theta}{dt^2} = 10^{12}\times[\{(\pi/6)\div(T_{ca(n)})\}-\{(\pi/6)\div(T_{ca(n-1)})\}]/\{(T_{ca(n-1)})+(T_{ca(n)})\}/2 \qquad \text{(Equation 2)}$$

This represents angular acceleration $\alpha_{n-1\sim n}$ calculated based on a predetermined angle passage time $T_{ca(n-1)}$ acquired at the (n−1)-th from timer start, and a predetermined angle passage time $T_{ca(n)}$ acquired at the n-th. That is, $\alpha_{n-1\sim n}$ is the angular acceleration average from the measurement start edge to the measurement end edge in an angle range (60°) which is twice the predetermined rotation angle (30°=π/6 rad).

Figure 4:
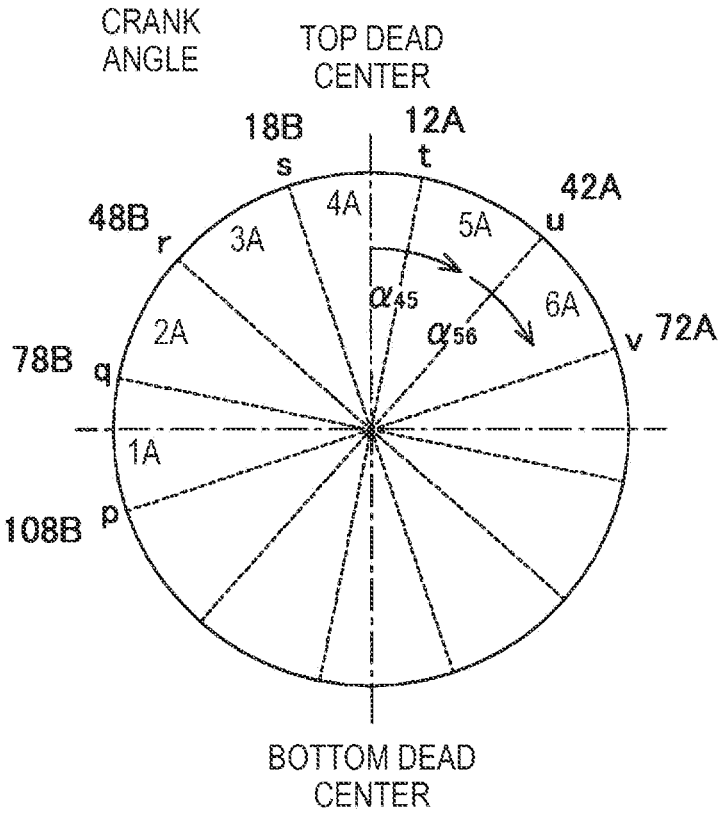
FIG. 4 is a schematic diagram illustrating a set example of a crank angle for calculating the rotational angular velocity and rotational angular acceleration of the crankshaft.

For example, FIG. 4 is a schematic diagram illustrating a case of calculating a predetermined angle passage time, angular velocity, and angular acceleration at intervals of 30° in a period when the piston P of the determined cylinder is in a 180° area before and after the compression top dead center.

Here, the 180° crank angle area from timer start to timer stop is divided into six 30° areas. Angular acceleration calculated according to an angular velocity based on a time when the crankshaft passes through an area 4A (from 18° before the top dead center to 12° after the top dead center) which is the fourth area from timer start), and an angular velocity based on a time when the crankshaft passes through an area 5A (from 12° before the top dead center to 42° after the top dead center) is denoted by, and angular acceleration calculated according to an angular velocity of the area 5A, and an angular velocity based on a time when the crankshaft passes through an area 6A (from 42° before the top dead center to 72° after the top dead center) is denoted by $\alpha_{45}$ is an angular acceleration average from a measurement start edge s and a measurement end edge u in the corresponding 60° range. $\alpha_{56}$ is an angular acceleration average from a measurement start edge u and a measurement end edge v in the corresponding 60° range.

The heat generation timing calculating means 23 calculates the gravity center position of total heat generation G of the corresponding cylinder, according to the change in angular acceleration, based on information on the angular acceleration calculated by the angular acceleration calculating means 22.

The gravity center position of total heat generation G is timing when the integrated value of combustion energy (heat) generated from combustion start in a case where energy (heat) generated from combustion start to combustion end in one cycle of one cylinder is 100 reaches 50 which is a half of 100. That is, the position of a crank angle θ at which the amount of heat generation reaches 50% of the total amount of heat generation of one cycle of one cylinder is the gravity center position of total heat generation G.

The amount of heat generation can be obtained by integrating the rate of heat generation (the amount of heat generation at each unit crank angle). However, in the present invention, the amount of heat generation is not directly calculated, and in consideration of a linear correlation between the gravity center position of total heat generation G and a difference Δα between the values of two angular velocities $\alpha_{n-1\sim n}$ and $\alpha_{n\sim n+1}$ which are acquired according time series or rotation the crankshaft C, the gravity center position of total heat generation G is obtained based on change of angular acceleration and the torque value of the engine E. Also, in the present embodiment, timing when the crankshaft reaches the corresponding range is calculated in consideration of the gravity center position of total heat generation G. However, the present invention can be implemented, for example, by acquiring a correlation between Δα and timing when the integrated value of the amount of heat generation reaches a range from 30% to 80% of the total amount of heat generation, in advance, and calculating timing when the integrated value reaches the corresponding range based on change of angular acceleration and the torque value of the engine E.

Figure 5:
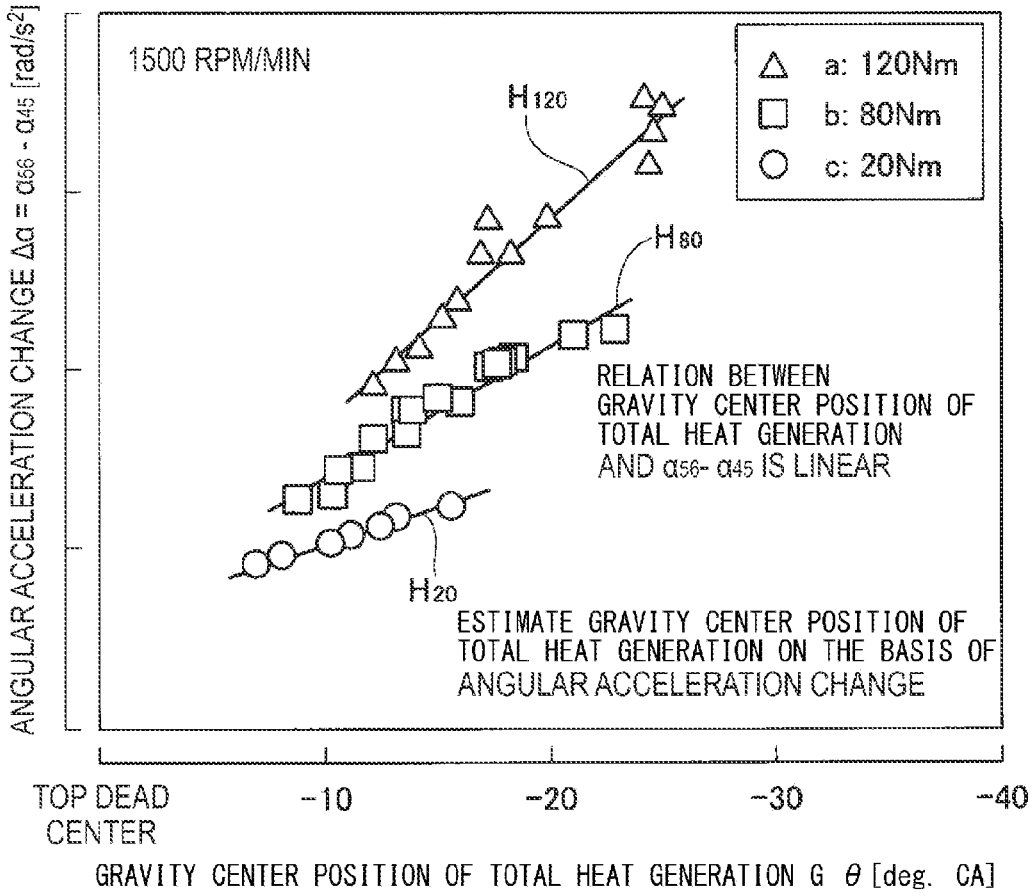
FIG. 5 is a graph illustrating the relation between the amount of change of the rotational angular acceleration of the crankshaft and a gravity center position of total heat generation.

For example, FIG. 5 is a graph illustrating a correlation for calculating the gravity center position of total heat generation G. Here, the horizontal axis represents the crank angle θ of the gravity center position of total heat generation G, and the vertical axis represents change of angular acceleration, that is, the difference Δα between the values of two angular velocities $\alpha_{n-1\sim n}$ and $\alpha_{n\sim n+1}$. Here, n is set to 5, and $\Delta\alpha=\alpha_{5\sim 6}-\alpha_{4\sim 5}$ is expressed as $\Delta\alpha=\alpha_{56}-\alpha_{45}$.

For example, in a case where the generated torque of the engine is 120 Nm, in FIG. 5, the relation between the crank angle θ of the gravity center position of total heat generation G and the angular acceleration change $\Delta\alpha=\alpha_{56}-\alpha_{45}$ has a distribution shown by a Δ mark (a) positioned highest. These information can be obtained in advance by experiments using the same type of master engines and the like. Based on the distribution of these information, an approximate expression H120 based on the method of least squares is obtained. If the angular acceleration change $\Delta\alpha=\alpha_{56}-\alpha_{45}$ is determined under the condition that the generated torque is 120 Nm by the approximate expression H120, it is possible to obtain the crank angle θ of the gravity center position of total heat generation G.

Also, for example, in a case where the generated torque of the engine is 80 Nm, in FIG. 5, the relation between the crank angle θ of the gravity center position of total heat generation G and the angular acceleration change $\Delta\alpha=\alpha_{56}-\alpha_{45}$ has a distribution shown by a □ mark (b) positioned in the middle. In a case where the generated torque of the engine is 20 Nm, in FIG. 5, the relation between the crank angle θ of the gravity center position of total heat generation G and the angular acceleration change $\Delta\alpha=\alpha_{56}-\alpha_{45}$ has a distribution shown by a ○ mark (c) positioned in the middle.

If a similar approximate expression is obtained under any other torque condition that the torque is, for example, 100 Nm, 60 Nm, or 40 Nm, and the angular acceleration change $\Delta\alpha=\alpha_{56}-\alpha_{45}$ is determined under that torque condition, it is possible to obtain the crank angle v of the gravity center position of total heat generation G. A pitch of torque for acquiring data can be freely set to 10 Nm, 20 Nm, or the like.

However, FIG. 5 shows the relation between the crank angle θ of the gravity center position of total heat generation G and the angular acceleration change $\Delta\alpha=\alpha_{n\sim n+1}-\alpha_{n-1\sim n}$ under a condition that the speed of the engine is 1500 rpm/min. Even at any other engine speed, for example, 2000 rpm/min, 2500 rpm/min, or 3500 rpm/min, if a similar map is obtained, and a torque condition and the angular acceleration change $\Delta\alpha=\alpha_{56}-\alpha_{45}$ are determined, it is possible to obtain the crank angle θ of the gravity center position of total heat generation G. A pitch of the engine speed for acquiring data can be freely set to 500 rpm/min, 100 rpm/min, or the like.

Here, of two angular acceleration values and (in the embodiment, $\alpha_{45}$ and $\alpha_{56}$), the prior angular acceleration value (in the embodiment, $\alpha_{45}$) in chronological order is preferably a value detected in a crank angle range including the top dead center in the beginning of the expansion stroke.

That is, it is because the value of the angular acceleration change $\Delta\alpha=\alpha_{n\sim n+1}-\alpha_{n-1\sim n}$ which is a reference for calculating the gravity center position of total heat generation G has the strongest correlation with the position of the gravity center position of total heat generation G in a certain period before and after a top dead center passage timing in the beginning of the expansion stroke.

This is because, for example, if angular accelerations $\alpha_{n\sim n+1}$ . . . are calculated based on only information on an angular velocity $\omega_n$ during acquisition start after the crankshaft has completely passed through the top dead center in the beginning of the expansion stroke, and the subsequent angular velocities $\omega_{n+1}$, $\omega_{n+2}$, . . . , the gravity center position of total heat generation G is calculated only information after combustion has partially started. Also, this is because, for example, if angular accelerations $\alpha_{n\sim n+1}$ . . . are calculated based on only information on an angular velocity $\omega_n$ during acquisition start after the crankshaft has completely passed through the top dead center in the beginning of the expansion stroke, and the subsequent angular velocities $\omega_{n+1}$, $\omega_{n+2}$, . . . , a lot of information on areas where combustion has not started is included.

Also, on the occasion of calculating the angular acceleration change $\Delta\alpha=\alpha_{n\sim n+1}-\alpha_{n-1\sim n}$ to be a reference for calculating the gravity center position of total heat generation G, the value of the prior angular acceleration $\alpha_{n-1\sim n}$ in chronological order is more preferably a value calculated based on the angular velocity $\omega_{n-1}$ detected in a crank angle range including the top dead center in the beginning of the expansion stroke and the angular velocity $\omega_n$ detected in a crank angle range after the crank angle range including the top dead center.

Based on information on the gravity center position of total heat generation G obtained in that way, the combustion control means 24 of the electronic control unit 20 calculates information on appropriate fuel injection timing and an amount of fuel injection by comparing the gravity center position of total heat generation G which is calculated by the heat generation timing calculating means 23 with a predetermined gravity center position of total heat generation reference value $G_0$. Then, the combustion control means 24 commands the fuel injection performing means 25 to correct necessary fuel injection timing. Further, the combustion control means 24 can compare the generated torque and target torque in a state where correction on the fuel injection timing has been commanded. In a case where the generated torque and the target torque are different, the combustion control means 24 can command the fuel injection performing means 25 to correct an necessary amount of fuel injection such that the generated torque coincides with the target torque.

Here, the gravity center position of total heat generation reference value $G_0$ is the position of the gravity center position of total heat generation which is determined as being appropriate sine misfire and the like do not occur under various driving conditions, in addition to the above described conditions for calculating the gravity center position of total heat generation G, that is, the torque condition, the value of the angular acceleration change, and the value of the engine speed. Information on the gravity center position of total heat generation reference value $G_0$ can be acquired in advance by experiments using the same type of master engines and the like (see, for example, FIG. 9 to be described below). Also, this is similar with respect to information on the target torque.

The combustion control means 24 performs control such that the gravity center position of total heat generation G which is calculated by the heat generation timing calculating means 23 becomes close to the gravity center position of total heat generation reference value $G_0$. In the present embodiment, control of the combustion control means 24 on internal combustion of a cylinder is performed by adjusting fuel injection timing or an amount of fuel injection.

Specifically, in a case where the gravity center position of total heat generation G is timing later than the gravity center position of total heat generation reference value $G_0$, the fuel injection timing is advanced from the current state such that the gravity center position of total heat generation G becomes close to the gravity center position of total heat generation reference value $G_0$. Inversely, in a case where the gravity center position of total heat generation G is timing earlier than the gravity center position of total heat generation reference value $G_0$, the fuel injection timing is delayed from the current state such that the gravity center position of total heat generation G becomes close to the gravity center position of total heat generation reference value $G_0$. Also, normally, the amount of fuel injection is proportional to the duration of fuel injection.

Control of the combustion control means 24 on the internal combustion state of a cylinder can be separately performed for each identified cylinder, or be simultaneously performed on one cylinder group including the determined cylinder and making progress by the same process as that of the determined cylinder.

Correction on fuel injection using this method is performed on each of all cylinders of the engine, such that the gravity center position of total heat generation G of combustion of every cylinder becomes close to the gravity center position of total heat generation reference value $G_0$. Preferably, the gravity center position of total heat generation G of combustion of every cylinder is matched with the gravity center position of total heat generation reference value $G_0$. As a result, it is possible to effectively reduce variation of combustion fluctuation between cylinders of the engine.

The action and control method of the control device of the engine will be described based on the flow chart of FIG. 6 and the like.

Figure 6:
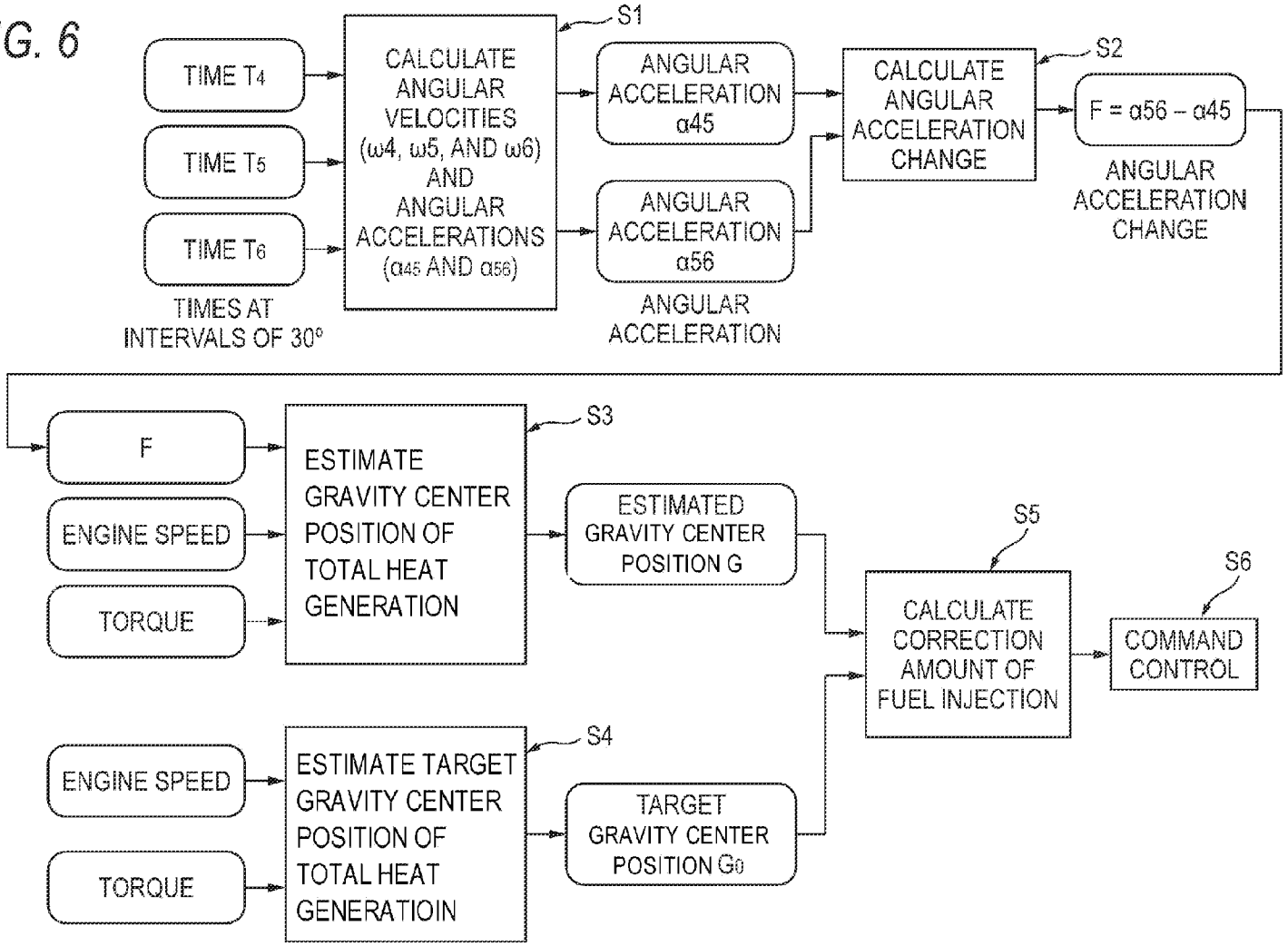
FIG. 6 is a flow chart of control which is performed by a control device of an engine according to an embodiment of the present invention.

STEP S1 shown in FIG. 6 is a stage of calculating angular velocities $\omega_4$, $\omega_5$, and $\omega_6$ when the crankshaft passes through the predetermined rotation angle (30°), based on predetermined angle passage times $T_4$, $T_5$, and $T_6$ which are times when the crankshaft passes through the predetermined rotation angle (30°), and calculating angular accelerations $\alpha_{45}$ and $\alpha_{56}$ based on the angular velocities $\omega_4$, $\omega_5$, and $\omega_6$.

STEP S2 is a stage of calculating an angular acceleration change, that is, the difference $\Delta\alpha(=\alpha_{56}-\alpha_{45})$ between the two angular accelerations $\alpha_{45}$ and $\alpha_{56}$ based on the angular accelerations $\alpha_{45}$ and $\alpha_{56}$ calculated in STEP S1.

STEP S3 is a stage of estimating the gravity center position of total heat generation G based on the angular acceleration change $\Delta\alpha=\alpha_{56}-\alpha_{45}$ calculated in STEP S2, a torque condition, and an engine speed condition. STEP S4 is a stage of estimating the gravity center position of total heat generation reference value $G_0$ similarly based on the torque condition and the engine speed condition.

STEP S5 is a stage of calculating a correction amount of the fuel injection timing based on the gravity center position of total heat generation G and the gravity center position of total heat generation reference value $G_0$ calculated in STEPS S3 and S4. Also, STEP S6 is a stage of commanding correction on the fuel injection timing. Also, in STEP S6, in a case where the generated torque and target torque of each cylinder are different in a state where the gravity center position of total heat generation G is close to or coincides with the gravity center position of total heat generation reference value $G_0$, if necessary, it is possible to perform control to increase the amount of fuel injection with respect to the specific cylinder.

Figure 7:
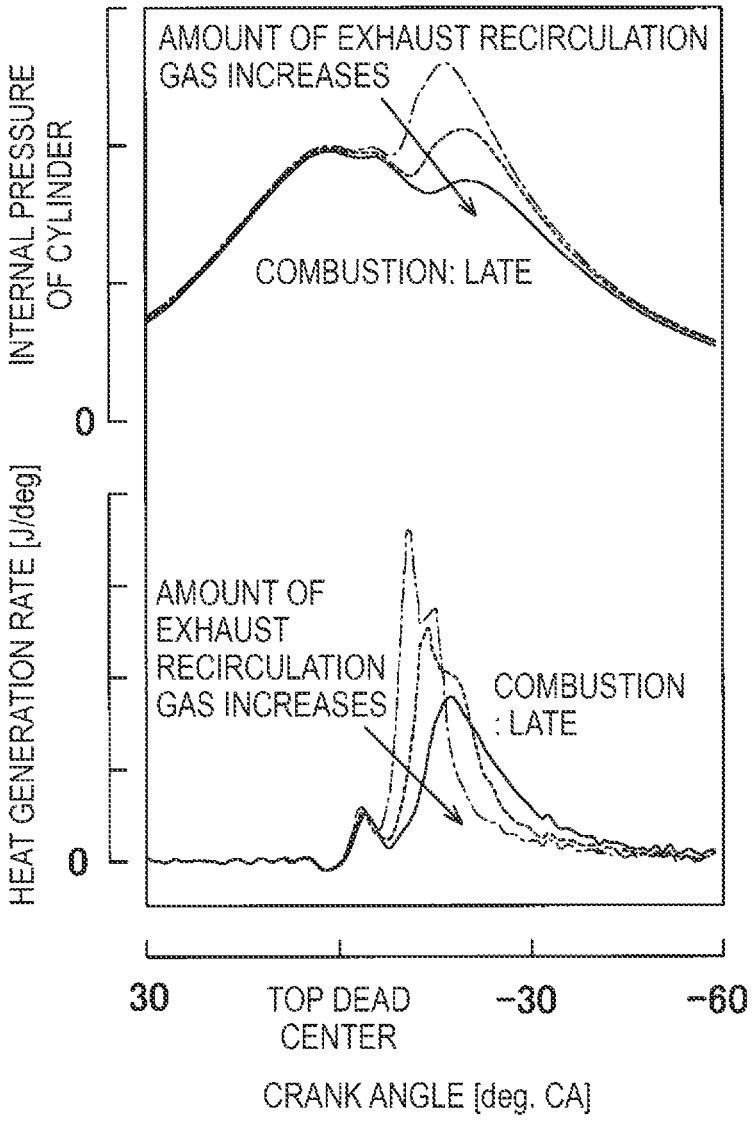
FIG. 7 is a graph illustrating the relation between the internal pressure of a cylinder and crank angle and the relation between a heat generation rate and crank angle.

In FIG. 7, the upper portion shows the relation between the internal pressures of a cylinder and the crank angle, and the lower portion shows the relation between the heat generation rate and the crank angle.

In the upper diagram, the amount of exhaust recirculation gas which is contained in mixture gas to be introduced into a cylinder increases in the order of a dot-dashed line, a broken line, and a solid line. The fuel injection timing is fixed. With the increase in the amount of exhaust recirculation gas, the height of the peak of the internal pressure of the cylinder after the top dead center tends to gradually decrease. Also, the position of that peak tends to be gradually delayed. Further, it can be considered that, if the amount of exhaust recirculation gas is increased, finally, misfire occurs.

Figure 8:
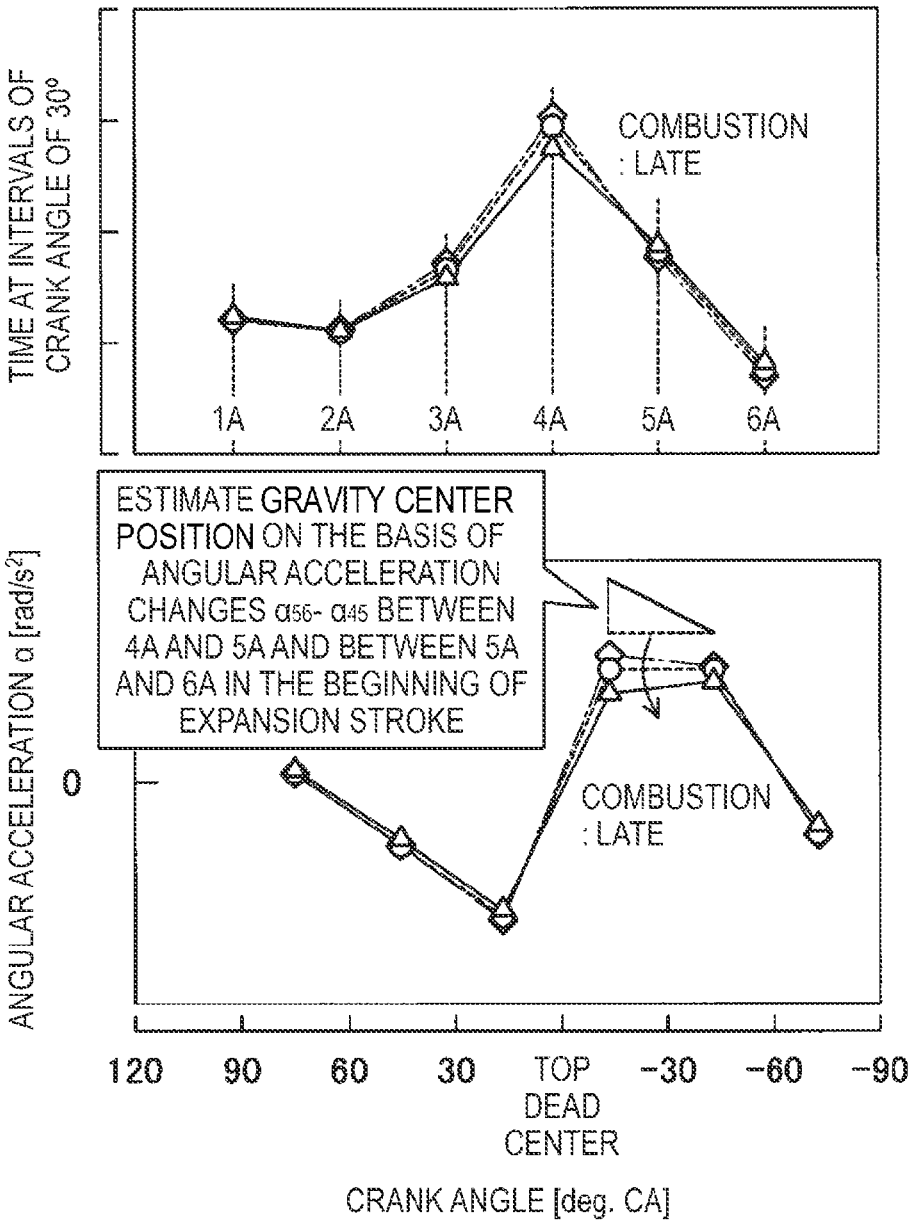
FIG. 8 is a graph illustrating the relation between crank angle and time which is required for the crankshaft to rotate 30°, and the relation between the rotational angular acceleration of the crankshaft and crank angle.

In the middle diagram, similarly, the amount of exhaust recirculation gas which is contained in mixture gas to be introduced into a cylinder increases in the order of a dot-dashed line, a broken line, and a solid line. With the increase in the amount of exhaust recirculation gas, the height of the peak of the heat generation rate (instantaneous value) per unit angle after the top dead center tends to gradually decrease. Also, the position of that peak tends to be gradually delayed. Also, it can be understood that, with the increase in the amount of exhaust recirculation gas, In FIG. 8, the upper portion shows the relation between the crank angle and the time required for the crankshaft to rotate by 30°, and the lower portion shows the relation between the angular acceleration of rotation of the crankshaft and the crank angle.

In the upper diagram, similarly, the amount of exhaust recirculation gas which is contained in mixture gas to be introduced into a cylinder increases in the order of a dot-dashed line, a broken line, and a solid line. With the increase in the amount of exhaust recirculation gas, the predetermined angle passage times $T_3$ and $T_4$ in an area (the area 3A) immediately before the top dead center and an area (the area 4A) around the top dead center remarkably decreases. In contrast, predetermined angle passage times $T_5$ and $T_6$ in areas (the areas 5A and 6A) after the top dead center slightly increases.

Variation in the amount of exhaust recirculation gas shown by a dot-dashed line, a broken line, and a solid line in the lower diagram is the same as description in the above example. With the increase in the amount of exhaust recirculation gas, the angular acceleration $\alpha_{34}$ slightly increases between the area 3A before the top dead center and the area 4A around the top dead center; whereas the angular acceleration $\alpha_{45}$ decreases between the area 4A after the top dead center and the area 5A, and similarly, the angular acceleration $\alpha_{56}$ decreases between the area 5A and the area 6A.

Therefore, with the increase in the amount of exhaust recirculation gas, the difference $\Delta\alpha(=\alpha_{56}-\alpha_{45})$ between the angular accelerations $\alpha_{45}$ and $\alpha_{56}$ before and after the top dead center tends to decrease. Also, it can be considered that, due to the decrease of the angular velocity and the decrease of the angular acceleration after the top dead center, the progress speed of combustion decreases, and the gravity center position of total heat generation G moves toward the delay side.

Figure 9:
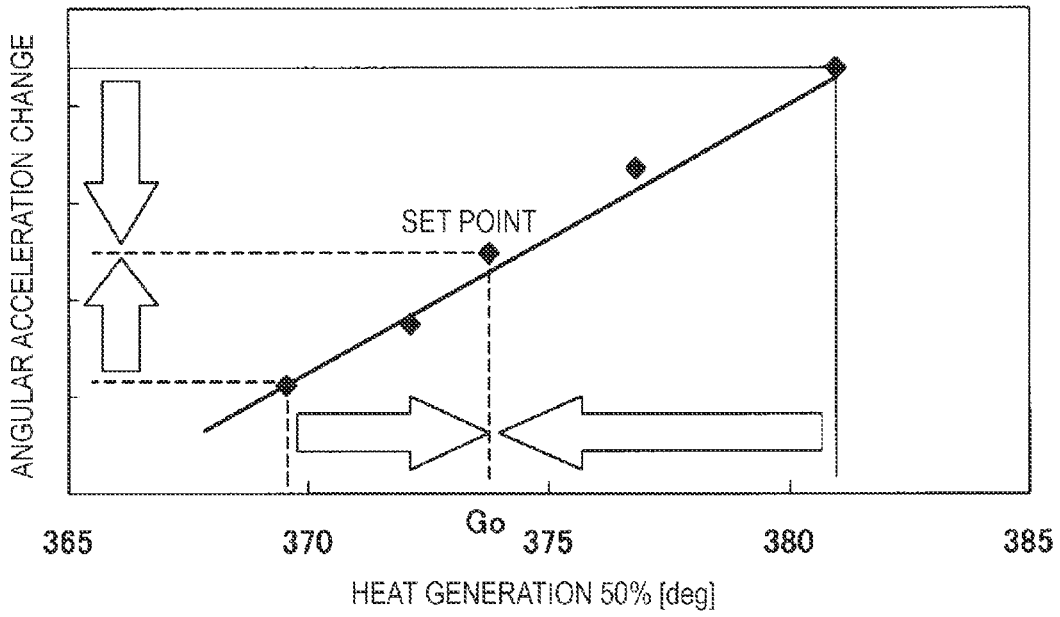
FIG. 9 is a graph illustrating the relation between change of the rotational angular acceleration of the crankshaft and the gravity center position of total heat generation.

FIG. 9 is a graph illustrating the relation between variation of the angular acceleration a of rotation of the crankshaft C and the gravity center position of total heat generation G Based on the value of the difference $\Delta\alpha(=\alpha_{56}-\alpha_{45})$ between the angular accelerations $\alpha_{45}$ and $\alpha_{56}$ on the vertical axis, the gravity center position of total heat generation G of one cycle of the cylinder is estimated, and in a case where the gravity center position of total heat generation G is timing later than the gravity center position of total heat generation reference value $G_0$, control is performed to advance the fuel injection timing from the current state such that the gravity center position of total heat generation G becomes close to the gravity center position of total heat generation reference value $G_0$ as shown by arrows on the right side of FIG. 9.

On the contrary, in a case where the gravity center position of total heat generation G is timing earlier than the gravity center position of total heat generation reference value $G_0$, control is performed to delay the fuel injection timing from the current state such that the gravity center position of total heat generation G becomes close to the gravity center position of total heat generation reference value $G_0$ as shown by arrows on the left side of FIG. 9.

In that case, the combustion control means 24 can calculate a necessary delay amount or advance amount of the fuel injection timing based on a map and the like held in the electronic control unit 20.

Figure 10A:
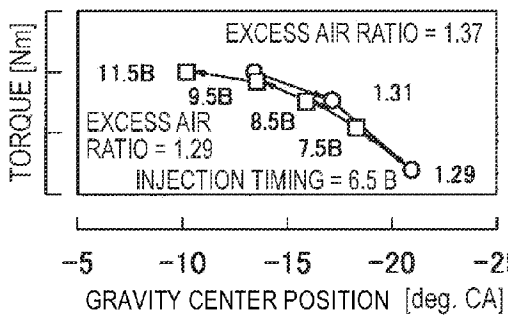
FIGS. 10A to 10C are graphs illustrating the relation between generated torque and the gravity center position of total heat generation, the relation between noise and the gravity center position of total heat generation, and the relation between change of the rotational angular acceleration of the crankshaft and the gravity center position of total heat generation, respectively.
Figure 10D:
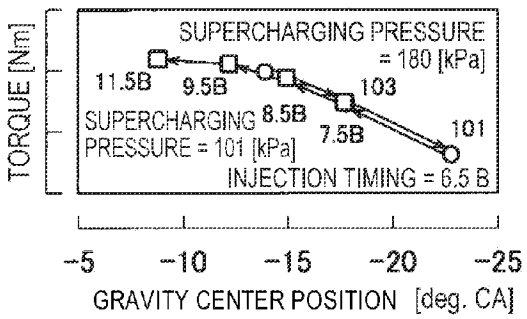
FIGS. 10D to 10F are illustrating the relation between generated torque and the gravity center position of total heat generation, the relation between noise and the gravity center position of total heat generation, and the relation between change of the rotational angular acceleration of the crankshaft and the gravity center position of total heat generation, respectively.
Figure 10B:
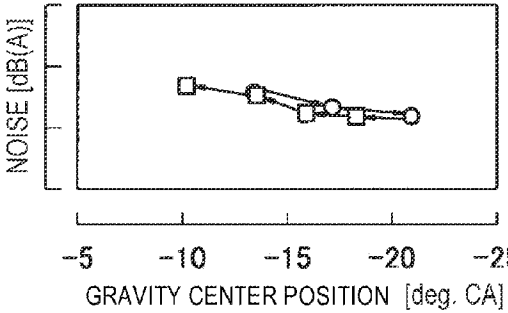
Figure 10E:
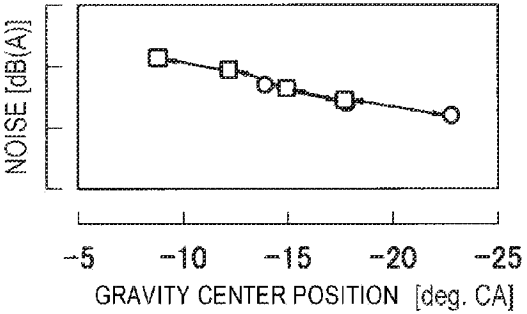
Figure 10C:
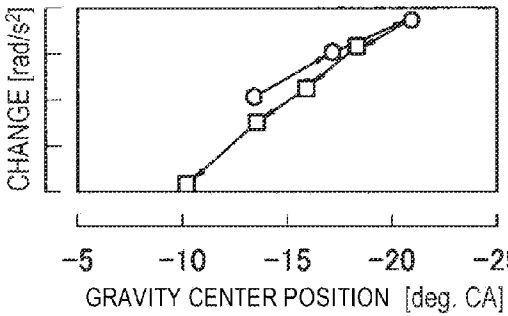
Figure 10F:
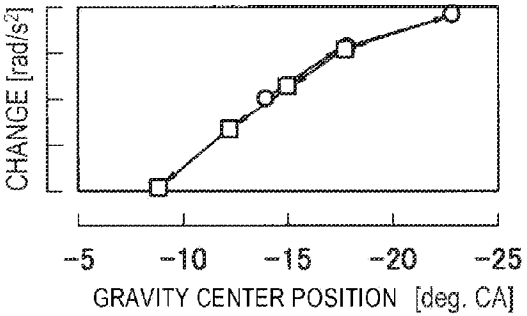

FIGS. 10A to 10C are graphs illustrating the relation between the generated torque of the engine E and the gravity center position of total heat generation, the relation between noise and the gravity center position of total heat generation G, and the relation between the angular-acceleration change of rotation of the crankshaft C and the gravity center position of total heat generation respectively. FIGS. 10D to 10F are graphs illustrating the relation between the generated torque of the engine E and the gravity center position of total heat generation G, the relation between noise and the gravity center position of total heat generation G, and the relation between the angular acceleration change of rotation of the crankshaft C and the gravity center position of total heat generation G, respectively.

If the amount of exhaust recirculation gas is increased and an excess air ratio is gradually decreased from 1.37 to 1.29 through 1.31 as shown by arrows in FIG. 10A, the gravity center position of total heat generation G moves toward the delay side. In this case, the torque also decreases.

However, it can be seen that, if the fuel injection timing is gradually advanced from a crank angle of 6.5° after the top dead center to 11.5° through 7.5°, 8.5°, and 9.5° while the excess air ratio is kept at 1.29, the gravity center position of total heat generation G also moves toward the advance side. In this case, the torque also increases and returns to the level before the increase of the amount of exhaust recirculation gas.

In this case, as shown in FIG. 10B, the level of noise from the engine decreases with movement of the gravity center position of total heat generation G toward the delay side, and increases with movement of the gravity center position of total heat generation G toward the advance side.

Also, as shown in FIG. 10C, the angular acceleration change of the crankshaft C increases with movement of the gravity center position of total heat generation G toward the delay side, and decreases with movement of the gravity center position of total heat generation G toward the advance side.

Also, as shown in FIG. 10D, if the supercharging pressure is gradually decreased from 108 kPa to 101 kPa through 103 kPa, with decrease of the amount of air (the amount of oxygen), the gravity center position of total heat generation G moves toward the delay side. In this case, the torque also decreases.

However, it can be seen that, if the fuel injection timing is gradually advanced from a crank angle of 6.5° after the top dead center to 11.5° through 7.5°, 8.5°, and 9.5° while the supercharging pressure is kept at 101 kPa, the gravity center position of total heat generation G also moves toward the advance side. In this case, the torque also increases and returns to the level before the decrease of the supercharging pressure.

In this case, as shown in FIG. 10E, the level of noise from the engine decreases with movement of the gravity center position of total heat generation G toward the delay side, and increases with movement of the gravity center position of total heat generation G toward the advance side.

Also, as shown in FIG. 10F, the angular acceleration change of the crankshaft C increases with movement of the gravity center position of total heat generation G toward the delay side, and decreases with movement of the gravity center position of total heat generation G toward the advance side.

As described above, according to the present invention, the angular acceleration a is calculated based on the angular velocity $\omega$ of the crankshaft C which is driven according to the output of the engine E, and based on a change in the angular acceleration $\alpha$, the gravity center position of total heat generation G of the cylinder is calculated. Therefore, it is possible to precisely control the internal combustion state of the cylinder based on comparison between the calculated gravity center position of total heat generation G and the gravity center position of total heat generation reference value $G_0$ which is a reference. Especially, it is effective to estimate the gravity center position of total heat generation G based on a variation in the angular acceleration a in the beginning of the expansion stroke and perform control to follow the gravity center position of total heat generation reference value $G_0$ which is a target value.

In the above described embodiment, as the heat generation timing calculating means 23, a gravity center position of total heat generation calculating means 23 which calculates the gravity center position of total heat generation G in a cylinder based on an angular acceleration change which is calculated by the angular acceleration calculating means 22 is used, and control is performed based on the gravity center position of total heat generation G which is calculated by the gravity center position of total heat generation calculating means 23. However, as an index which is calculated by the heat generation timing calculating means 23 and becomes a control origin, any other index other than the gravity center position of total heat generation G may be used.

For example, based on the angular acceleration change which is calculated by the angular acceleration calculating means 22, the heat generation timing calculating means 23 may calculate the certain timing when the ratio of the amount of heat generation in a cylinder to the total amount of heat generation of one cycle becomes a predetermined ratio of 30% or 40%.

In this case, the combustion control means 24 controls combustion in the cylinder by comparing the certain timing which is calculated by the heat generation timing calculating means 23 with the predetermined heat generation timing reference value.

In a case where the certain timing is timing when the integrated value of the amount of heat generation in the cylinder for the cycle is 30% of the total amount of heat generation of one cycle, the heat generation timing reference value is set to a reference value corresponding to the certain timing of 30%, and in a case where the certain timing is timing when the integrated value of the amount of heat generation in the cylinder for the cycle is 40% of the total amount of heat generation of one cycle, the heat generation timing reference value is set to a reference value corresponding to the certain timing of 40%.

In the above described each embodiment, the diesel engine which is a compression self-ignition type engine has been described as an example. However, the present invention is not limited to the embodiment. The present invention can also be applied to, for example, 2-cycle gasoline engines or 4-cycle gasoline engines. Also, the present invention can applied to reciprocating engines usable in various transport machines and industrial machines in addition to vehicles.

In a case of a gasoline engine, the configuration of the engine includes an ignition plug which is provided at the upper portion of the cylinder shown in FIG. 1 for igniting fuel in a combustion chamber. The ignition timing of the ignition plug can be controlled by the control means 26 of the electronic control unit 20.

Even in a case of a gasoline engine, similarly in the above described embodiment, for example, based on the value of the difference $\Delta\alpha(=\alpha_{56}-\alpha_{45})$ between the angular accelerations $\alpha_{45}$ and $\alpha_{56}$ of the crankshaft C, the gravity center position of total heat generation G of one cycle of the cylinder is estimated. In a case where the gravity center position of total heat generation G is timing later than the gravity center position of total heat generation reference value $G_0$, control is performed to advance the fuel injection timing, the ignition timing, or the like from the current state such that the gravity center position of total heat generation G becomes close to the gravity center position of total heat generation reference value $G_0$.

On the contrary, in a case where the gravity center position of total heat generation G is timing earlier than the gravity center position of total heat generation reference value $G_0$, control is performed to delay the injection timing, the ignition timing, or the like from the current state such that the gravity center position of total heat generation G becomes close to the gravity center position of total heat generation reference value $G_0$.

The combustion control means 24 can calculate a necessary delay amount or advance amount of the fuel injection timing based on a map and the like held in the electronic control unit 20. The gasoline engine is the same as the embodiment in that the electronic control unit 20 retains calculation data relative to the gravity center position of total heat generation reference value $G_0$, the heat generation timing reference value, and the target torque.

According to the present invention, based on the angular velocity of the rotating shaft which is driven according to the output of the engine, the angular velocity is calculated. Then, based on a variation in the angular acceleration, certain timing when the amount of heat generation of the cylinder becomes a ratio in a predetermined range, and gravity center position of total heat generation are calculated. Therefore, it is possible to control combustion based on comparison of the certain timing and gravity center position of total heat generation calculated with the heat generation timing reference value and a gravity center position of total heat generation reference value which are references, thereby keeping satisfactory combustion state in the cylinder.

What is claimed is:

1. A control device for an engine comprising:

an angular velocity detecting unit that detects the angular velocity of a rotating shaft which is driven according to an output of an engine;

an angular acceleration calculating unit that calculates angular acceleration based on the angular velocity detected by the angular velocity detecting unit, the angular acceleration calculating unit calculating angular acceleration values detected in a crank angle range including a top dead center in a beginning of an expansions stroke and a crank angle range after the top dead center, and calculating a difference between a calculated angular acceleration value in the crank angle range including the top dead center and a calculated angular acceleration value after the top dead center;

a heat generation timing calculating unit that calculates a certain timing when the ratio of an amount of heat generation in a cylinder to the total amount of heat generation of one cycle falls in a predetermined range, based on the calculated difference; and a combustion control unit that controls combustion in the cylinder by comparison between the certain timing calculated by the heat generation timing calculating unit and a predetermined heat generation timing reference value.

2. The control device for an engine according to claim 1, wherein the certain timing is a gravity center position of total heat generation, and the heat generation timing calculating unit includes a gravity center position of total heat generation calculating unit.

3. The control device for an engine according to claim 1, wherein the angular acceleration change is calculated based on two angular accelerations which are obtained as references in chronological order, and of the values of the two angular accelerations, the value of the prior angular acceleration in chronological order is an angular acceleration value detected in the crank angle range including the top dead center.

4. The control device for an engine according to claim 2, wherein the combustion control unit controls the gravity center position of total heat generation which is calculated by the gravity center position of total heat generation calculating unit such that the gravity center position of total heat generation becomes close to a gravity center position of total heat generation reference value.

5. The control device for an engine according to claim 2, wherein control of the combustion control unit on the internal combustion state of a cylinder is performed by adjusting fuel injection timing or an amount of fuel injection.

6. The control device for an engine according to claim 2, wherein the gravity center position of total heat generation is obtained based on a difference between two angular acceleration values which are obtained in chronological order and the generated torque of the engine.

* * * * *